US006325682B1

(12) United States Patent
Seidler

(10) Patent No.: US 6,325,682 B1
(45) **Date of Patent: *Dec. 4, 2001**

(54) COLLAPSIBLE ELECTRICAL LEADS FOR ENGAGING A SUBSTRATE

(75) Inventor: Jack Seidler, Flushing, NY (US)

(73) Assignee: North American Specialties Corporation, Flushing, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/458,348

(22) Filed: Dec. 10, 1999

Related U.S. Application Data

(60) Provisional application No. 60/112,233, filed on Dec. 14, 1998.

(51) Int. Cl.[7] ..... H01R 4/02
(52) U.S. Cl. ..... 439/876; 439/83
(58) Field of Search ..... 439/876, 83, 441

(56) References Cited

U.S. PATENT DOCUMENTS

| | | | | |
|---|---|---|---|---|
| 5,310,367 | * | 5/1994 | Seidler | 439/876 |
| 5,334,059 | | 8/1994 | Seidler | 439/876 |
| 5,569,056 | | 10/1996 | Raimond | 439/876 |

* cited by examiner

*Primary Examiner*—Paula Bradley
*Assistant Examiner*—Ann McCamey
(74) *Attorney, Agent, or Firm*—Darby & Darby

(57) ABSTRACT

An electrical lead includes a substrate-receiving section which has a collapsible rear plate and a plurality of outwardly projecting prongs or arms. The prongs are spaced apart to define a gap having an opening slightly larger than the width of the substrate to be engaged. A substrate is inserted into the gap between the prongs so that the prongs are spaced on either side of the substrate. The rear plate of the lead is then compressed so that the prongs engage and tightly grip the substrate from opposite sides. Alternatively, the prongs may pivot upon the application of force to engage the substrate.

20 Claims, 2 Drawing Sheets

FIG. 6
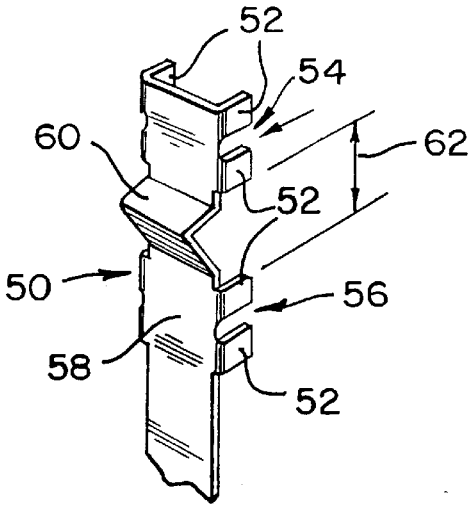
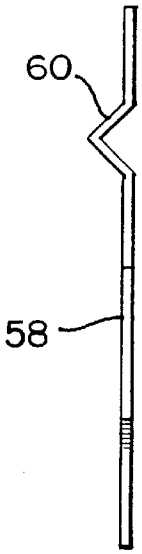
FIG. 7
FIG. 8
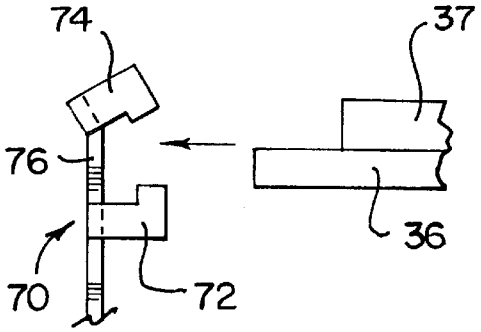
FIG. 9
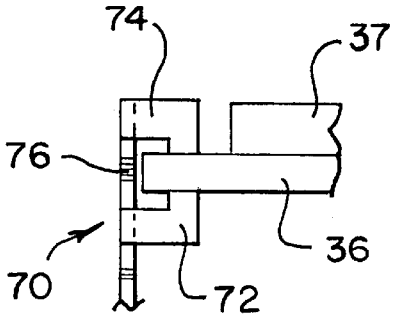
FIG. 10
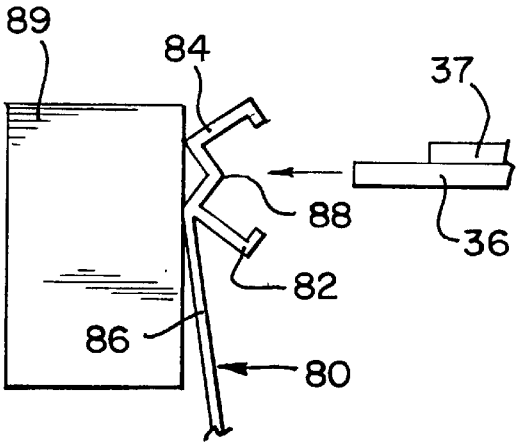
FIG. 11
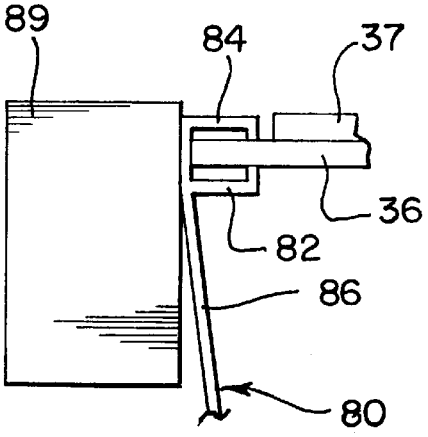

COLLAPSIBLE ELECTRICAL LEADS FOR ENGAGING A SUBSTRATE

This application claims priority pursuant to 35 U.S.C. §119 from Provisional Patent Application Serial No. 60/112,233 filed Dec. 14, 1998, the entire disclosure of which is hereby incorporated by reference.

FIELD OF THE INVENTION

The present invention generally relates to the field of electrical leads and connectors for engaging, and establishing electrical communication with, circuit bearing boards, chips, chip carriers or other substrates. More specifically, the present invention relates to a collapsible lead designed to capture or clamp onto the substrate and firmly hold the substrate in place, while also establishing electrical communication with the substrate.

DESCRIPTION OF THE RELATED ART

Conventional circuit connectors for engaging a substrate are well known in the art. By way of example, U.S. Pat. No. 4,433,892, issued Feb. 28, 1984 to the assignee of the present application, discloses a lead having a clip for mounting a subsidiary substrate vertically on a base substrate, the lead having a terminal portion adapted to be retained and soldered in a hole in the base substrate. U.S. Pat. No. 4,697,865 issued Oct. 6, 1987 to the present assignee also discloses a clip lead for mounting a subsidiary substrate on a base substrate, in a within-the-hole manner, but parallel to the base substrate. A similar arrangement is shown in U.S. Pat. No. 4,592,617 granted Jun. 3, 1986 to the present assignee. The contents of these patents are expressly incorporated herein by reference.

Another form of electrical lead is designed to allow the substrate to be inserted into it (an insertion-type lead). One example of such a lead is shown in FIG. 1. The lead is formed having an inclined plane lead-in to facilitate insertion of the substrate into the lead. To accommodate the lead-in, the lead must have a relatively large throat depth T (i.e., the depth of the lead opening). For the substrate to be properly engaged to the lead, it must be inserted a significant distance into the lead.

However, as electrical components become smaller and smaller, the space between components becomes smaller and smaller. Many substrates are formed with caps or components mounted on top of them, with the distance between the substrate edge and the cap edge being very small, typically on the order of a few mils. Thus, the available portion of the substrate (i.e., the distance between the substrate edge and the edge of the cap) is often not deep enough to allow a lead-in type lead to properly engage the substrate. The lead abuts against the edge of the cap before it can securely engage the substrate.

Accordingly, it will be apparent that there continues to be a need for an electrical lead which is of the insertion type to receive a portion of a substrate body to engage and securely hold the substrate to establish electrical communication with the substrate. In addition, a need exists for an electrical lead of the insertion type that has a small throat depth to accommodate substrates having small uncovered perimeter regions. The present invention addresses these needs.

SUMMARY OF THE INVENTION

It is a principal object of the present invention to provide an insertion-type electrical lead which is designed to engage substrates having very little available area for connection to the lead.

It is another object of the present invention to provide an electrical lead which is collapsible or capable of bending to engage or clamp onto a substrate, such that the lead may be formed with a relatively small throat depth and still securely engage the substrate.

In one illustrative embodiment, the electrical lead according to the present invention includes a substrate-receiving clip which has a collapsible (or compressible) rear plate and a plurality of outwardly projecting, spaced apart prongs which define a gap (or intermediate space) between them, the gap being slightly larger than the thickness of the substrate to be engaged. Thus, the substrate may be inserted into the clip so that the prongs are disposed on either side of the substrate. The clip is then forcibly compressed (in a controlled manner) so that the prongs engage and tightly grip the substrate from opposite sides. In this manner, the throat depth of the lead can be made relatively small and will still engage a substrate, even one having a small uncovered perimeter region.

BRIEF DESCRIPTION OF THE DRAWINGS

FIG. 6 is a perspective view of yet another illustrative embodiment of the electrical lead of the invention;

FIG. 7 is a side elevation view of a blank which may be stamped to form the electrical lead of FIG. 6;

FIG. 8 is a side elevation view of still another illustrative embodiment of the electrical lead of the invention, with the lead in an unengaged position;

FIG. 9 is a side elevation view of the electrical lead of FIG. 8 in an engaged position;

FIG. 10 is a side elevation view of another illustrative embodiment of the electrical lead of the invention, with the lead in an unengaged position; and FIG. 11 is a side elevation view of the electrical lead of FIG. 10 in an engaged position.

DETAILED DESCRIPTION OF THE PREFERRED EMBODIMENTS

Figure 1:
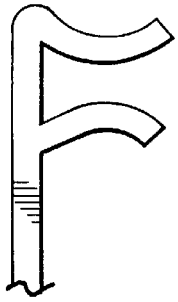
FIG. 1 PRIOR ART
FIG. 1 is a side elevation view of a prior art electrical lead having a relatively deep throat.
Figure 2:
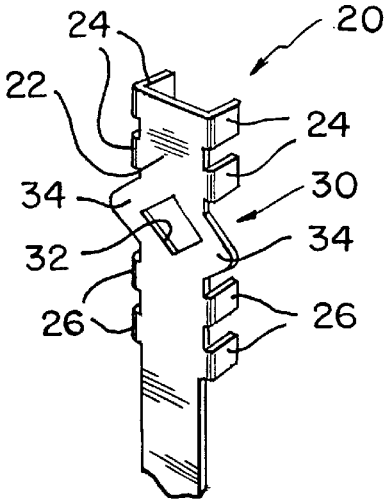
FIG. 2 is a fragmented perspective view of one embodiment of an electrical lead according to the present invention.
Figure 4:
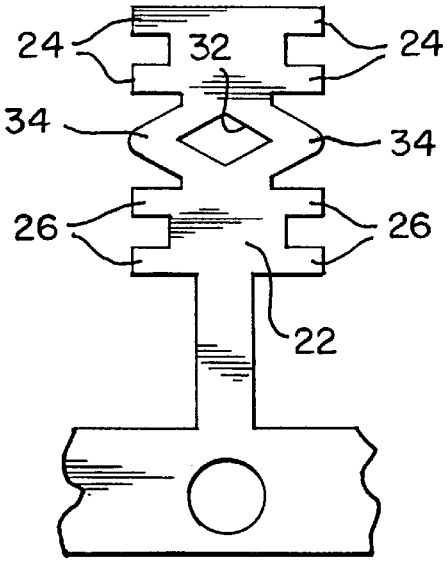
FIG. 4 is a plan view of a blank which may be progressively stamped to create the electrical lead shown in FIG. 2.
Figure 3:
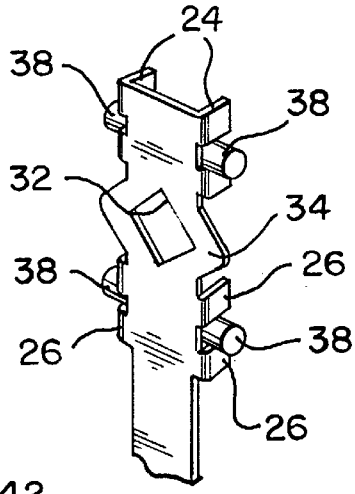
FIG. 3 is a fragmented perspective view similar to FIG. 2 and showing the electrical lead with solder applied to it.

Referring to the drawings, FIGS. 2 through 4 illustrate one embodiment of an electrical lead 20 according to the present invention. The electrical lead includes an electrically conductive rear plate 22 having a longitudinal axis, and a number of electrically conductive gripping prongs 24 extending outwardly from the rear plate , generally perpendicular to the longitudinal axis and adjacent the upper end of the plate. The plate also includes a second group of electrically conductive gripping prongs 26 extending outwardly from the rear plate adjacent the lower end of the plate. The prongs 24 and 26 define a gap 30 therebetween. Prior to the lead being crimped onto the substrate, the gap is slightly larger than the thickness of the substrate to be engaged. In one embodiment, the upper and lower groups each include four prongs, (preferably integrally formed with the plate) with two located on either lateral side of the lead.

The rear plate 22 is preferably formed of deformable, conductive material with a diamond-shaped cut-out 32 which is interposed between the upper and lower prong groups to weaken the rear plate in that region. The outer edges 34 of the rear plate are preferably curved outwardly in that region as well. The rear plate is preferably formed of a thickness which allows the plate to be compressed, for example, about five to six mils thick, generally along the longitudinal axis.

A substrate 36, such as a printed circuit board, integrated circuit chip, chip carrier or other substrate (as shown in FIG. 8 with a cap 37 mounted on it) is inserted into the gap 30 between the prong groups 26 and 28, and an external, compressive force applied to the rear plate (along the longitudinal axis) to cause the middle region of the rear plate 22 to collapse, thereby reducing the gap 30 between the prong groups to bring the prong groups closer together, such that the prongs 24 of the respective prong groups engage the opposite surfaces of the substrate and tightly hold it. The result is that the lead becomes mechanically and electrically connected to the substrate. Although a diamond-shaped cut-out 32 is shown, any other suitable shape may be used which will easily and predictably collapse upon the application of a suitable force. The substrate may be provided with conductive pads or traces (not shown) for electrical connection to the lead.

In one illustrative embodiment, prior to inserting the substrate 36 into the electrical lead 20, the lead may be coated with a layer of solder, or a solder mass 38 may be deposited between the respective prong pairs 24 (FIG. 3). The solder may then be heated during the insertion step to assist in securely connecting the substrate 36 and lead 20.

Figure 5:
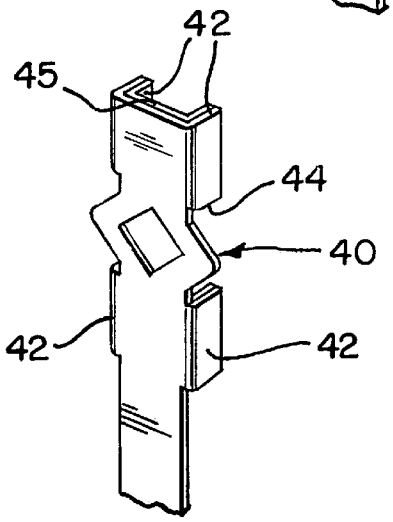
FIG. 5 is a perspective view of another illustrative embodiment of the electrical lead of the invention.

Referring to FIG. 5, there is shown another embodiment of the electrical lead 40 of the invention. The lead 40 is similar in many respects to the lead 20. However, in place of the plurality of prongs 24, the lead 40 includes four outwardly projecting arms 42. In all other material respects, the lead 40 is identical to the lead 20. The upper two arms and the lower two arms define a gap 44 between them, into which the substrate 36 may be inserted. The rear plate is then compressed such that the arms sandwich the substrate between them. As with the lead 20, the lead 40 may be coated with a layer of solder 45 prior to insertion of the substrate 36 to facilitate the connection between lead 40 and substrate 36.

Referring now to FIGS. 6 and 7, there is shown yet another embodiment of the lead 50 of the invention. The electrical lead 50 includes a plurality of spaced apart prongs 52 which are divided into upper and lower prong groups 54 and 56, as with the lead 20 shown in FIG. 2. The rear plate 58 of the lead is formed with a generally V-shaped ripple bend 60 (FIG. 7) which is formed between the upper and lower prong groups. The ripple bend defines a weak point for the rear plate, such that an external, compressive force applied to the rear plate will cause the ripple bend to compress upon itself, thereby reducing the gap 62 between the respective prong groups. Again, solder may be deposited on the lead 50 (either by way of a solder mass or solder coating) before the substrate 36 is inserted into the gap to facilitate connection of the lead and substrate.

Thus, substrate 36 may be inserted into the gap 62, and a compressive force applied to the rear plate 58 to cause the rear plate to compress and bring the prongs into tight engagement with the substrate.

Referring to FIGS. 8 and 9, yet another illustrative embodiment of the electrical lead 70 of the present invention is shown. The lead includes a pair of opposing jaw segments 72 and 74 projecting outwardly from the rear plate 76 of the lead 70, with the lower jaw segment 72 projecting generally perpendicular to the rear plate, and the upper jaw segment 74 projecting at an angle of less than 90 degrees relative to the rear plate. The rear plate is bendable, such that an external force applied to the upper jaw segment 74 causes the jaw segment to pivot with respect to the rear plate so that it projects generally perpendicular to the rear plate (FIG. 9), with the respective jaw segments 72 and 74 trapping the substrate 36 between them. While one jaw is shown as pivoting, both jaws may pivot to engage the substrate.

Referring now to FIGS. 10 and 11, another illustrative embodiment of the electrical lead 80 is shown. The lead 80 includes upper and lower jaw segments 84 and 82, and a flexible, deformable rear plate 86 formed with a V-shaped bend 88. A substrate 36 is inserted into the gap between the jaw segments and is forced against the rear plate 86, with the rear plate placed against a block 89. As a result, the rear plate is straightened to remove the bend 88 (FIG. 11), which causes the upper jaw portion to pivot toward the lower jaw portion such that the jaw portions tightly grip the substrate between them. While one jaw is shown as pivoting, both jaws may pivot to engage the substrate.

The electrical leads according to the present invention are preferably formed by conventional multi-stage, progressive stamping, in a conventional manner well known to those skilled in the art, to bend a flat, elongated, narrow conductive body (FIG. 4) to provide the rear plates with the respective prongs or arms.

Various ways of holding solder on the arms and/or prongs may be utilized. One suitable form is shown, for example, in U.S. Pat. No. 4,592,617 granted Jun. 3, 1986 to the assignee of the present application, the disclosure of which is hereby expressly incorporated by reference.

Accordingly, the present invention provides electrical leads which are collapsible to engage a substrate. By making the lead collapsible, the lead does not require a large throat depth, and can therefore engage substrates having small uncovered perimeter regions.

What is claimed is:

1. An electrical lead to be mechanically secured to a substrate having a thickness, the lead comprising:

an elongated body defining a longitudinal axis, and having an upper end, an intermediate point, a front, a rear, and two opposing sides;

an upper prong integrally formed with said body adjacent to said upper end, said upper prong extending forwardly, perpendicular to said longitudinal axis;

a lower prong integrally formed with said body at said intermediate point, said lower prong extending forwardly, perpendicular to said longitudinal axis and generally parallel to said upper prong, said lower prong and upper prong defining an intermediate space therebetween for receiving said substrate; and a compressible region integrally formed with said body between said upper end and said intermediate point, wherein said compressible region is compressed along said longitudinal axis from a first non-compressed position wherein said intermediate space is wider than the thickness of said substrate to a compressed position where said intermediate space is generally equal to the thickness of said substrate.

2. The electrical lead, according to claim 1, wherein a portion of solder is attached to said upper prong, said solder fusing said upper prong to said substrate, after the application of heat.

3. The electrical lead, according to claim 1, wherein a portion of solder is attached to said lower prong, said solder fusing said upper prong to said substrate, after the application of heat.

4. The electrical lead, according to claim 1, wherein said upper prong includes two prongs.

5. The electrical lead, according to claim 1, wherein said lower prong includes two prongs.

6. The electrical lead, according to claim 1, wherein the compressible region includes a cut-out formed in the elongated body for weakening the body in the compressible region.

7. The electrical lead, according to claim 1, wherein the elongated body includes a bent portion in the compressible region for defining weak point in the compressible region.

8. The electrical lead, according to claim 1, wherein the elongated body is modified in the compressible region so as to weaken the elongated body in the compressible region and permit compressing of the region from the first position to the second position.

9. An electrical lead to be mechanically secured to a substrate having a thickness, the lead comprising:

an elongated body defining a longitudinal axis, and having an upper end, an intermediate point, a front, a rear, and two opposing sides;

an upper prong integrally formed with said body adjacent to said upper end;

a lower prong integrally formed with said body at said intermediate point, said lower prong and said upper prong defining an intermediate space therebetween for receiving said substrate; and a bendable region integrally formed with said body located between said upper end and said intermediate point, wherein said bendable region is bent along said longitudinal axis at a point between the upper and lower prongs from an open position where said intermediate space is wider than the thickness of said substrate and said upper prong and lower prong are at acute angles with respect to said longitudinal axis, to a closed position wherein said intermediate space is generally equal to the thickness of said substrate.

10. The electrical lead, according to claim 9, wherein a portion of solder is attached to said upper prong, said solder fusing said upper prong to said substrate, after the application of heat.

11. The electrical lead, according to claim 9, wherein a portion of solder is attached to said lower prong, said solder fusing said upper prong to said substrate, after the application of heat.

12. The electrical lead, according to claim 9, wherein said upper prong includes two prongs.

13. The electrical lead, according to claim 9, wherein said lower prong includes two prongs.

14. The electrical lead, according to claim 9, wherein said bendable region is shaped so that it is forced from said open position to said closed position in response to insertion of said substrate into said intermediate space.

15. The electrical lead, according to claim 14, wherein a portion of solder is attached to said upper prong, said solder fusing said upper prong to said substrate, after the application of heat.

16. The electrical lead, according to claim 14, wherein a portion of solder is attached to said lower prong, said solder fusing said upper prong to said substrate, after the application of heat.

17. The electrical lead, according to claim 14, wherein said upper prong includes two prongs.

18. The electrical lead, according to claim 14, wherein said lower prong includes two prongs.

19. An electrical lead to be mechanically secured to a substrate having a thickness, the lead comprising:

an elongated body defining a longitudinal axis, and having an upper end, an intermediate point, a front, a rear, and two opposing sides;

an upper prong integrally formed with said body adjacent to said upper end, said upper prong extending forwardly, perpendicular to said body at said upper end;

a lower prong integrally formed with said body at said intermediate point, said lower prong extending forwardly, perpendicular to said longitudinal axis and generally parallel to said upper prong, said lower prong and said upper prong defining an intermediate space therebetween for receiving said substrate; and a bendable region integrally formed with said body located between said upper end and said intermediate point, wherein said bendable region is bent along said longitudinal axis at a point between said upper and lower prongs from an open position where said intermediate space is wider than the thickness of said substrate to a closed position wherein said intermediate space is generally equal to the thickness of said substrate.

20. An electrical lead to be mechanically secured to a substrate having a thickness, the lead comprising:

an elongated body defining a longitudinal axis, and having an upper end, an intermediate point, a front, a rear, and two opposing sides;

an upper prong integrally formed with said body adjacent to said upper end;

a lower prong integrally formed with said body at said intermediate point, said lower prong extending forwardly, perpendicular to said longitudinal axis, said lower prong and said upper prong defining an intermediate space therebetween for receiving said substrate; and a bendable region integrally formed with said body located between said upper end and said intermediate point, said bendable region having a portion bent rearwardly proximate to said upper prong, wherein said bendable region is bent along said longitudinal axis from an open position where said intermediate space is wider than the thickness of said substrate and said upper prong is at an acute angle with respect to said longitudinal axis, to a closed position wherein said intermediate space is generally equal to the thickness of said substrate and said upper prong extends forwardly, perpendicular to said longitudinal axis.

* * * * *